United States Patent [19]

Cazares et al.

[11] Patent Number: 4,881,275

[45] Date of Patent: Nov. 21, 1989

[54] BASKETBALL GRIPPING GLOVE

[76] Inventors: Albert Cazares, 5303 Manner Oak, Kingwood, Tex. 77339; Holland R. Gibson, Jr., 1162 Cottage Oak, Houston, Tex. 77091

[21] Appl. No.: 201,946

[22] Filed: Jun. 3, 1988

[51] Int. Cl.[4] ..... A41D 19/00; A63B 63/00

[52] U.S. Cl. ..... 2/161 A; 2/163; 2/168; 272/67; 273/1.5 A

[58] Field of Search ..... 2/161 A, 161 R, 163, 2/159, 168; 273/1.5 A, 1.5 R; 272/67; 128/26

[56] References Cited

U.S. PATENT DOCUMENTS

| | | | |
|---|---|---|---|
| 859,097 | 7/1907 | Miller | 2/161 R |
| 883,761 | 4/1908 | Taylor et al. | 2/161 R |
| 1,642,311 | 9/1927 | Richardson | 2/163 X |
| 4,675,913 | 6/1987 | Rockwell | 2/161 R |
| 4,774,727 | 10/1988 | Jackson | 2/161 A |

*Primary Examiner*—H. Hampton Hunter

*Attorney, Agent, or Firm*—Matthews & Associates

[57] ABSTRACT

A new and improved basketball gripping glove or gripping glove for any similar size spherical object or ball to be worn by a Basketball player or other athlete. The glove is constructed of a wrist anchor strap with a plurality of five elastomeric bands extending therefrom the other end of the bands being each attached to a single finger cowl for the five fingers of ones hand. The finger cowls are constructed of a material possessing a high coefficient of friction. The elastomeric bands must possess a sufficient coefficient of elasticity to retain the finger cowls over the finger tips and in direct abutment thereto. The anchor strap can be made of leather or other similar stretch resistant material. The strap is fastened by means of a buckle or loop and hook material. This glove allows one to grip a basketball with one hand in order to facilitate pass fakes and various other Basketball moves including "dunking". Additionally, a method of increasing the strength of ones hand and fingers by using the glove during athletic events or otherwise.

3 Claims, 1 Drawing Sheet

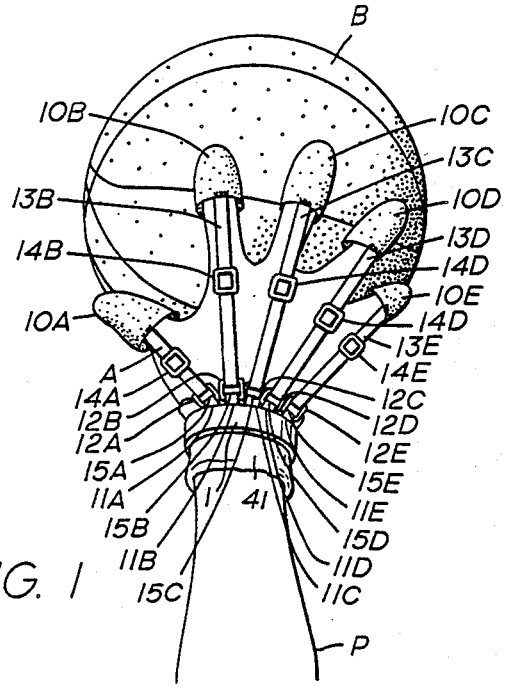
FIG. 1
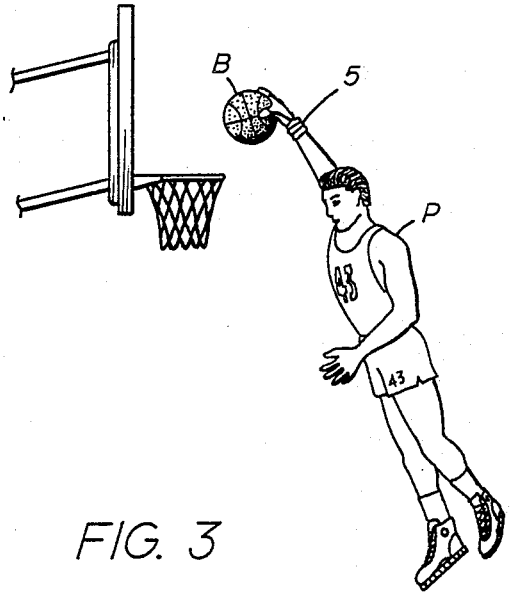
FIG. 3
FIG. 2
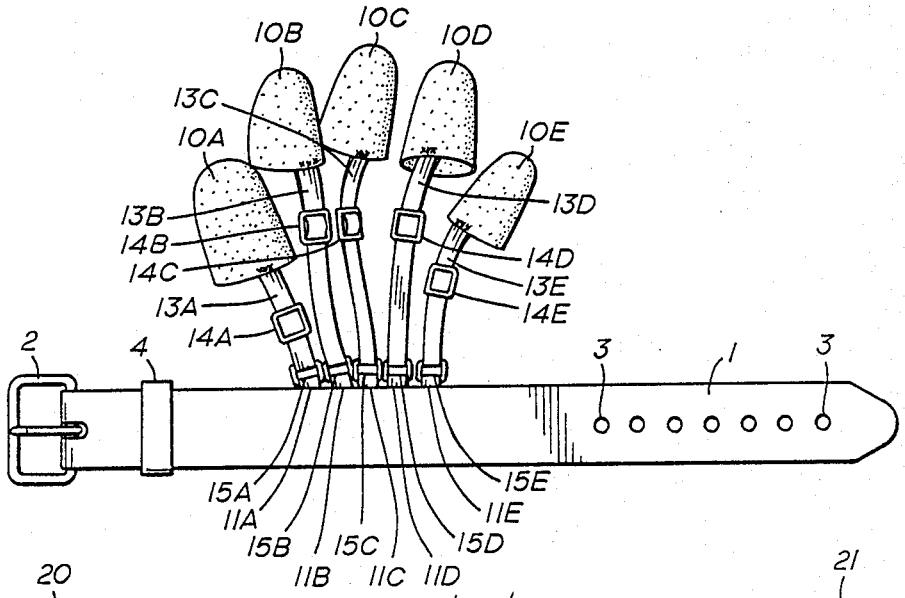
FIG. 4
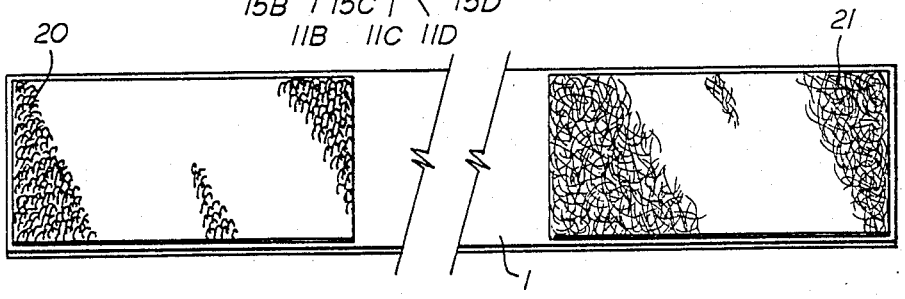

BASKETBALL GRIPPING GLOVE

BACKGROUND OF THE INVENTION

This invention relates to athletics and more particularly to the game of Basketball. The present invention enables one to easily grip a basketball or similar spherical object with one hand. Gripping a basketball with one hand enables a person to easily fake a pass, alter a dribble and physically make moves and shots toward the basket otherwise not possible.

There is little art in this area even remotely similar to the present invention. Available prior art discloses other types of sports gloves and hand covering apparatus relating to sports, recreational activities and hand protectors. Such art discloses full hand covering gloves as well as partial hand covering gloves and apparatus to be used for hand protection and to enhance the gripping of various items unrelated to a basketball.

The following U.S. Patents were considered in the investigation and evaluation of the prior art relative to the existing apparatus used with the invention:

| U.S. Pat. No. | Inventor | Issue Date |
|---|---|---|
| 4,675,913 | Rockwell | June 30, 1987 |
| 3,649,967 | Millman | Mar. 21, 1972 |
| 3,640,532 | Bauer | Feb. 8, 1972 |
| 2,985,885 | Layer | May 30, 1961 |

OBJECTS OF THE INVENTION

It is an object of this invention to provide a new and improved basketball gripping apparatus.

It is a further object of this invention to provide a new and improved basketball gripping apparatus which allows for shooting and or dribbling of the basketball while being worn.

It is still a further object of this invention to provide a new and improved basketball gripping apparatus which enables one to more easily "dunk" a basketball.

If is yet a further object of this invention to provide a new and improved method of strengthening ones hands and fingers.

BRIEF DESCRIPTION OF THE DRAWINGS

FIG. 1 is an overhead perspective view of the present invention being worn and used to grip a basketball.

FIG. 2 is a perspective view of the disclosed invention.

FIG. 3 is a perspective action view of an athlete using the disclosed invention when "dunking" a basketball.

FIG. 4 is a perspective view of an alternative embodiment of the disclosed invention.

SUMMARY OF THE INVENTION

Disclosed herein is a new and improved Basketball gripping apparatus of novel construction. The present invention is initially anchored about the users wrist. A latex type non-slip finger cowl covers the end of each finger from approximately the second knuckle outward. The finger cowls must be of a non-slip material on the outside. The inside of the cowls can be cloth or some other softer material which is more comfortable to the touch.

The finger cowls are attached to the wrist anchor strap by individual elastic bands or other similar material with elastic properties. The bands are attached to the lower top portion of the finger covering sections. That is, the bands must be attached to a point on the finger cowls which will generally lie just above the second knuckle of the fingers and first knuckle of the thumb.

The opposite end of each band is fixable attached to the wrist anchor strap. The anchoring strap is wrapped about the wrist. The anchoring strap is then buckled or fastened using VELCRO or other similar material. This anchor strap can be made of any material that resists slipping along the wrist, arm and/or hand yet remains comfortable after being snugly tightened about the wrist. A user of the present invention may be inclined to wear a wrist band or other similarly cushioning material underneath the wrist anchor strap for more comfortable use.

The elastic bands which connect the finger cowls to the wrist anchor strap must possess a substantially low coefficient of elasticity but must have some elasticity nonetheless. This coefficient of elasticity must be sufficiently low to insure the inside of the finger cowls always remain adjacent to and in direct abutment with its respective finger. By design, each elastomeric band is aligned directly above and runs in correspondence with each individual finger. The extra grasping friction available to each finger pursuant to the non-slip finger cowls enables one to easily pick up a basketball or other similarly spherical object with one hand.

A general description of how the present invention is worn is simply described. A user would initially fasten the wrist anchor strap about their wrist. The wrist anchor strap must fit snugly about the wrist and should be tightened sufficiently to avoid slipping down the arm, wrist and hand toward the fingers. However, it must be advised that one should not tighten the wrist anchor strap so much that blood circulation in the hand is restricted. The user may wish to wear a wrist band or other similarly cushioning material or device underneath the wrist anchor strap for more comfort and to further prohibit slipping. Subsequently, once the wrist anchor strap is snugly fastened, the user will place the five individual finger cowls over his five fingers of the appropriate hand. At this point the elastic bands may or may not need to be adjusted. Adjustment can be made by a slidable length adjustment means as more specifically described below. The adjustment means will allow for lengthening or shortening of the elastomeric bands such that compensation can be made for the various sizes of individuals hands.

An additional use for the present invention is that of strengthening the muscles of one hands and fingers. Due to the low coefficient of elasticity found in the elastomeric bands a constant substantial pulling force is encountered by each individual finger when the present invention is being used. This force is sufficient to exercise the fingers. Strengthened fingers and hand can be facilitated by various exercises which may be performed with the disclosed invention. One may, after attaching the glove to the hand close the fingers into a fist and subsequently release them backwards a series of times on a regular basis. This exercises the fingers as well as the hand and if done on a reguar basis can greatly increase the strength of both.

Additional features of the present invention will become apparent from a description of the preferred embodiment of the invention with reference to the accompanying drawings.

It can be seen in the prior art cited that the present invention is a novel apparatus. Rockwell, U.S. Pat. No. 4,675,913, discloses a glove designed to protect ones knuckles, thumbs, back of hands, wrists and fingertips when working. The invention disclosed comprises fingertip covers for each fingertip of a hand with knuckle covers protecting each knuckle and hand wrist and palm pads all connected together by elastic bands. Elastic bands are sectioned, and for each individual finger, connect the fingertip covers to a first knuckle cover, the first knuckle cover is then connected to the second knuckle cover by elastic and the second knuckle cover is then connected to the hand protector by elastic. Further, the elastic bands, by necessity, contain a rather high coefficient of elasticity in that the glove as described is to aid the workman by providing sufficient flexibility to accommodate for stretching when the hand closes completely around a tool. Without the high degree of flexibility the knuckle protectors would not remain aligned over the knuckles.

Millman discloses a non-slip glove to be used by Golfers when handling golf clubs. The claimed invention is a full glove covering the entire hand.

Bauer discloses a device to the used for teaching the proper way of controlling or dribbling a basketball. The device disclosed comprises a single elongated flexible tube which is secured to the palm of the individuals hand along with a plurality of axillary straps spaced between each of the four fingers of the individuals hand keeping them equally spaced apart.

Finally, Layer discloses an Archer's glove designed to cover only an individuals three middle fingers with the finger covering hoods being comprised of leather.

DETAILED DESCRIPTION OF THE PREFERRED EMBODIMENT

Referring to FIG. 2 of the drawings the present invention generally comprises an anchor strap 1 and a plurality of elastomeric bands, 15A–E, said bands being attached to elastic finger cowls made of a material with a high coefficient of friction.

The wrist anchor strap 1 can be made of leather or any other relatively non stretchable material. The strap 1 is then wrapped around the wrist snugly. The present embodiment discloses a means of fastening the strap about the wrist using a buckle 2. A plurality of holes 3 allow for various adjustments of the fastened anchor strap's circumference. Once buckled the loose end 5 of the anchor strap 1 that is held in place by a loop 4 which provides sufficient clearance within its interior above the strap 1 and the loose end 5 to pass through. The loop 4 is fixably attached at a point on the backside of anchor strap 1. Instead of a buckle, hook and loop material can also be used for fastening and adjusting the anchor strap 1.

Extending upwardly from anchor strap 1 is a plurality of bands, 15A–E. These elastic bands are subsequently attached to a circular rigid member, 12A–E. Attached the opposite of each circular rigid member, 12A–E, is adjustable straps, 13A–3 respectively. The means of adjustment for said straps, 13A–E, is a slidable adjustment means, 14A–E respectively. The adjustment means, 14A–E, can lengthen or shorten the elastic bands, 13A–E, in order that each band is properly adjustable for the individuals finger. Each band, 15A–E, is fixably attached at various points, 11A–E, along anchor strap 1. The free end of each slidably adjustable elastomeric band, 13A–E, is fixably attached to a finger cowls, 10A–E, at points 16A–E respectively. The attachment at points 16A–E can be accomplished by sewing the bands, 13A–E, to the finger cowls, 10A–E, or by some type of glue or any other means which is sufficient to stand up to the forces incurred. The finger cowls 10A–E are placed over the fingertips and extend just to the second knuckle of each finger and the first knuckle of the thumb. The finger cowls 10A–E should be placed over the fingertips such that the elastomeric bands 13A–E extends downward to the wrist anchor strap 1 substantially parallel to the users fingers.

The finger cowls 10A–E cover the end portions of each finger above the second knuckle and including the thumb. The user may wish to fasten the anchor to the anchor strap 1 about a wrist sweat band or other similar cushioned type material as indicated by 41 in FIG. 1.

FIG. 1 discloses the present invention being worn and used by an individual.

The elastomeric bands, 13A–E, must possess a coefficient of elasticity sufficiently low to restrict and maintain finger cowls 10A–E adjacent and in direct abutment to the user's fingers and thumb. Yet the bands 13A–E must have some degree of elasticity to allow for stretching.

FIG. 3 illustrates the present invention being used by a Basketball player in the process of "dunking" a basketball.

FIG. 4 discloses a hook 20 and loop 21 fastening means which may be used instead of the buckle of FIG. 2 described above.

Thus it is apparent that there has been provided, in accordance with the instant invention, a new and improved basketball gripping apparatus to enhance and improve ability of the average athlete, amateur as well as professional, that fully satisfies the object, aims and advantages set forth above. While the invention has been described in conjunction with specific embodiments thereof, it is evident that many alternatives, modifications and variations will be apparent to those skilled in the art in light of the foregoing description. Accordingly, this patent is intended to embrace all such alternatives, modifications and variations as fall within the spirit of the invention and scope of the appended claims.

What is claimed is:

1. A new and improved basketball gripping apparatus comprising:

a. an anchor strap;

b. a means of fastening said anchor strap about user's wrist;

c. five elastomeric bands d. one finger cowl for attachment to one end of each of said elastomeric bands opposite said anchor strap, wherein said finger cowls are constructed of a thin rubber, elastic or other material possessing a high coefficient of friction;

e. said elastomeric bands having a sufficiently low coefficient of elasticity to maintain said finger cowls adjacent to and in direct abutment with the user's fingers at all times; and wherein, f. said five elastomeric bands are made adjustable in length, with each band comprising; a ring; means operatively connecting said ring to said anchor strap; and a slide buckle, wherein each elastomeric band is fixed to said finger cowl at one end, with its second end threaded through said slide buckle and then through said ring and then fixed to said buckle.

2. A basketball gripping apparatus as described in claim 1 further comprising a wrist anchor strap with a buckle fastening mechanism with a plurality of holes located longitudinally along the center of the strap to allow for easy adjustment and various degrees of tightness about the wrist.

3. A basketball gripping apparatus as described in claim 1 further comprising a wrist anchor strap utilizing a hook and loop type material for a fastening means.

* * * * *